US006468184B1

(12) United States Patent
Lee

(10) Patent No.: US 6,468,184 B1
(45) Date of Patent: Oct. 22, 2002

(54) COMBINED CYCLING AND STEPPING EXERCISER

(76) Inventor: Sunny Lee, No. 257-8, Chung-Cheng Rd., Tsao-Tun Chen, Nan-Tou Hsien (TW)

( * ) Notice: Subject to any disclaimer, the term of this patent is extended or adjusted under 35 U.S.C. 154(b) by 14 days.

(21) Appl. No.: 09/836,734

(22) Filed: Apr. 17, 2001

(51) Int. Cl.[7] ..... A63B 69/16; A63B 22/04
(52) U.S. Cl. ..... 482/52; 482/57; 482/51
(58) Field of Search ..... 482/51, 52, 53, 482/57, 70, 79, 80

(56) References Cited

U.S. PATENT DOCUMENTS 6,126,574 A * 10/2000 Stearns et al. ..... 482/52
6,183,398 B1 * 2/2001 Rufino et al. ..... 482/57
6,196,948 B1 * 3/2001 Stearns et al. ..... 482/51
6,254,514 B1 * 7/2001 Maresh et al. ..... 482/52

* cited by examiner

*Primary Examiner*—Stephen R. Crow
(74) *Attorney, Agent, or Firm*—Merchant & Gould P.C.

(57) ABSTRACT

A combined cycling and stepping exerciser includes a base frame with an upright post, a drive wheel mounted on the base frame, a pair of elongated lever arms with front end portions pivoted to the upright post, a pair of slide seats, and pair of pedal arms disposed on the lever arms. Each of the lever arms has a longitudinal slide groove. Each of the slide seats is coupled to a respective crank arm of the drive wheel, and engages slidably the slide groove in a respective lever arm so as to be slidable along the slide groove. Each of the pedal members has a front end engaging slidably the slide groove in a respective lever arm. A pair of fasteners are operable for fastening rear ends of the pedal members selectively and respectively to the slide seats and to rear end portions of the lever arms.

8 Claims, 10 Drawing Sheets

COMBINED CYCLING AND STEPPING EXERCISER

BACKGROUND OF THE INVENTION

1. Field of the Invention

The present invention relates to an exerciser, more particularly to an exerciser which provides combined cycling and stepping exercise functions and which is capable of being converted to operate in one of cycling and stepping exercise modes.

2. Description of the Related Art

FIG. 1 illustrates a conventional cycling exerciser 10 which mainly includes a base frame 11 mounted with a resistance wheel 12 that is coupled to a drive wheel 13 for providing resistance to rotation of the drive wheel 13. The drive wheel 13 has a pair of crank arms 14 on opposite lateral sides thereof. The base frame 11 has an upright post 15 at a front end thereof. A pair of horizontal pivot shafts 16 project laterally from the upright post 15, and are connected pivotally to a pair of upright linking rods 17 which have lower ends connected pivotally to front ends of a pair of pedals 18 that are disposed on opposite lateral sides of the base frame 11. The pedals 18 are coupled to the crank arms 14, respectively, for propelling rotation of the drive wheel 13. However, the exerciser 10 can only perform a regular cycling exercise mode, and only exercises the knees and the ankles of the user.

SUMMARY OF THE INVENTION

The main object of the present invention is to provide a combined cycling and stepping exerciser which provides combined cycling and stepping exercise functions and which is capable of being converted to operate in one of cycling and stepping exercise modes.

Accordingly, the exerciser of the present invention includes a base frame, a drive wheel, a pair of elongated lever arms, a pair of slide seats, a pair of pedal arms and fasteners. The base frame has a front end portion with an upright post, and a rear end portion opposite to the front end portion in a longitudinal direction. The upright post is formed with a pair of horizontal pivot shafts that project in opposite lateral directions transverse to the longitudinal direction. The drive wheel is mounted rotatably on the rear end portion of the base frame. The drive wheel has a horizontal wheel axle transverse to the longitudinal direction, and a pair of crank arms coupled to the wheel axle and disposed on opposite lateral sides of the drive wheel. The elongated lever arms are disposed on opposite lateral sides of the base frame. Each of the lever arms has a front end portion pivoted to a respective one of the pivot shafts on the upright post, a rear end portion, and a longitudinally extending slide groove extending between the front and rear end portions. Each of the slide seats is coupled to a respective one of the crank arms, and engages slidably the slide groove in a respective one of the lever arms so as to be slidable along the slide groove when the drive wheel rotates. The pedal members are disposed respectively on the lever arms. Each of the pedal members has a front end engaging slidably the slide groove in the respective one of the lever arms, and a rear end. The fasteners are operable for fastening the rear ends of the pedal members selectively and respectively to the slide seats and to the rear end portions of the lever arms.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
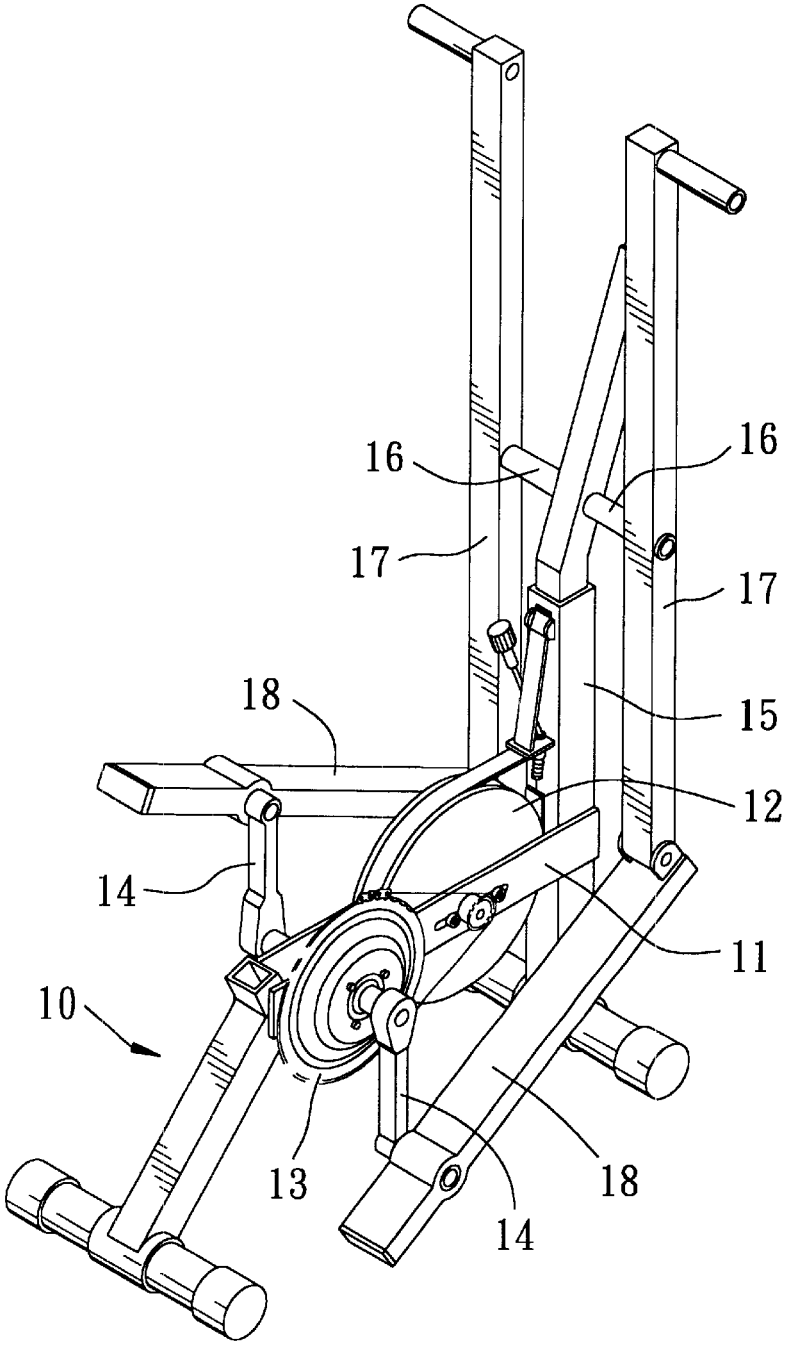
FIG. 1 PRIOR ART
FIG. 1 is a perspective view of a conventional cycling exerciser.
Figure 2:
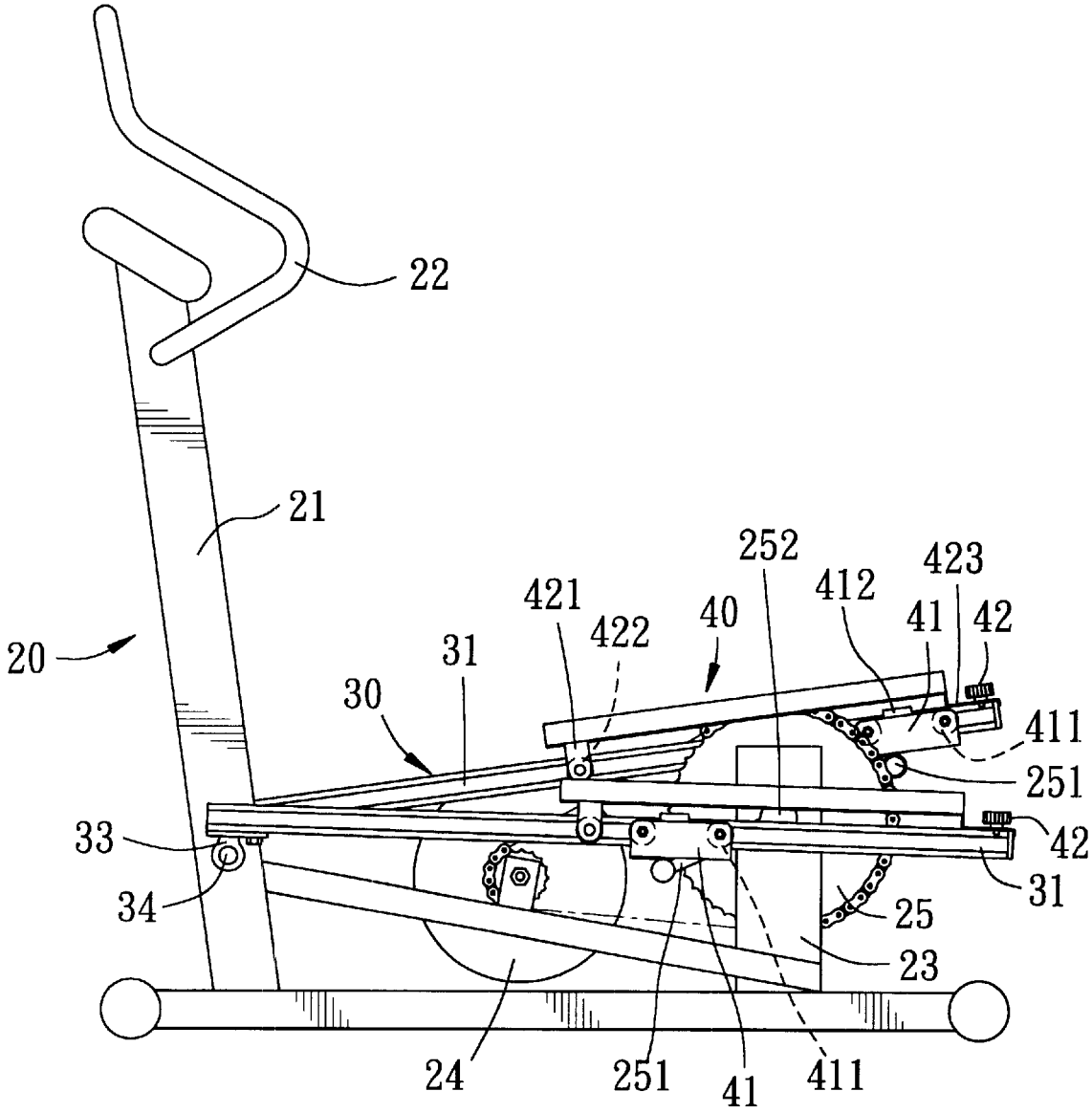
FIG. 2 is a side view of a preferred embodiment of the combined cycling and stepping exerciser of the present invention.

Referring to FIG. 2, the preferred embodiment of the combined cycling and stepping exerciser of the present invention is shown to include a base frame 20, a drive wheel 25, a resistance wheel 24, a pair of lever arms 30, a pair of slide seats 41, a pair of pedal members 40, and a pair of operable fasteners 42.

The base frame 20 has a front end portion formed with an upright front post 21, and a rear end portion opposite to the front end portion in a longitudinal direction and formed with an upright rear post 23. A pair of handle members 22 are secured to an upper end portion of the front post 21. A pair of horizontal pivot shafts 23 (see FIG. 5) project from a lower end portion of the front post 21 in opposite lateral directions. The drive wheel 25 is mounted rotatably on the rear post 23, and is coupled to the resistance wheel 24, which is mounted on the base frame 20. The resistance wheel 24 provides resistance to rotation of the drive wheel 25 in a known manner. The drive wheel 25 has a horizontal wheel axle 252 which extends in a direction transverse to the longitudinal direction and which has a pair of crank arms 251 disposed on opposite lateral sides of the drive wheel 25.

Figure 4:
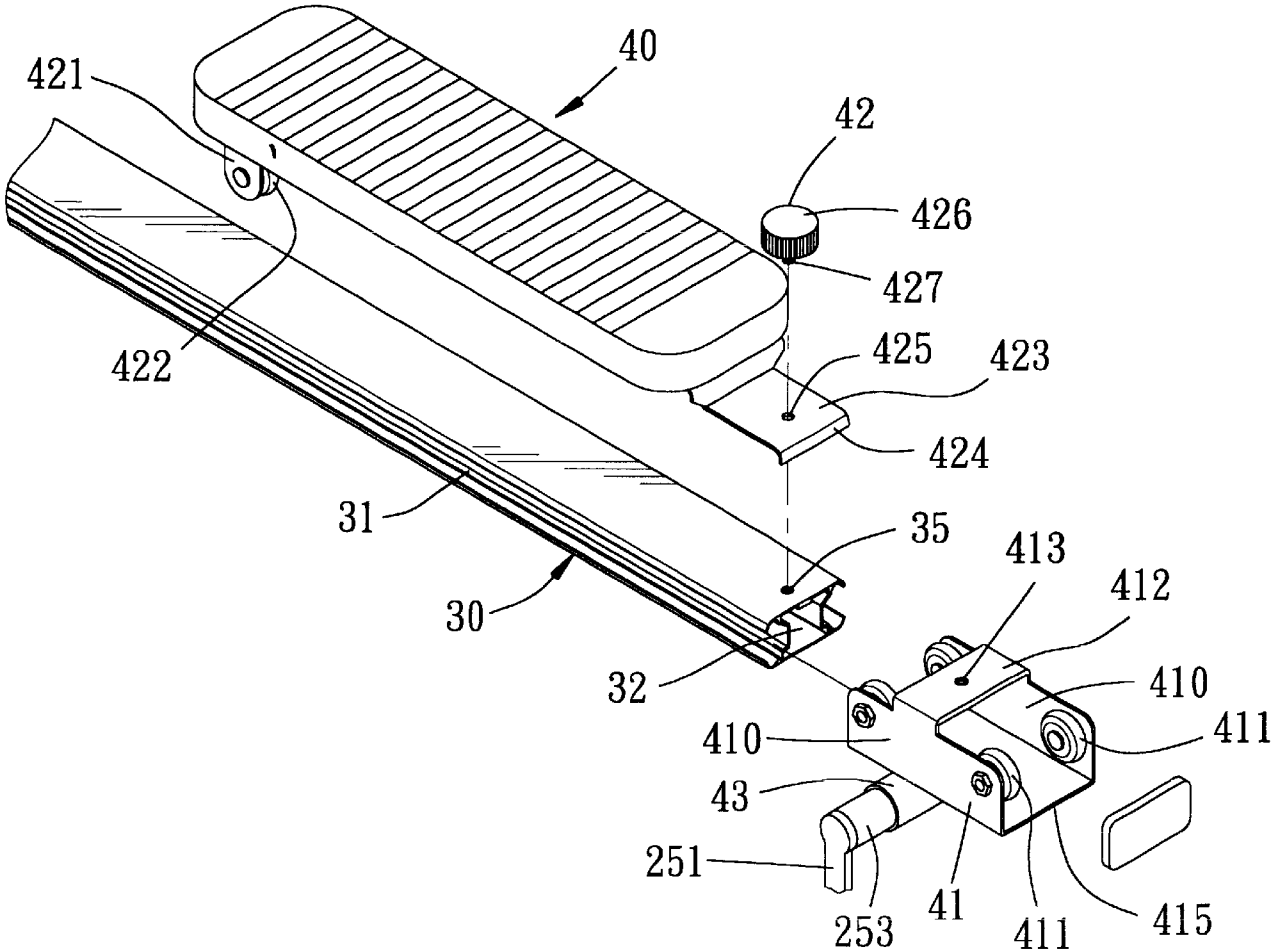
FIG. 4 is a fragmentary exploded perspective view of the present invention.
Figure 5:
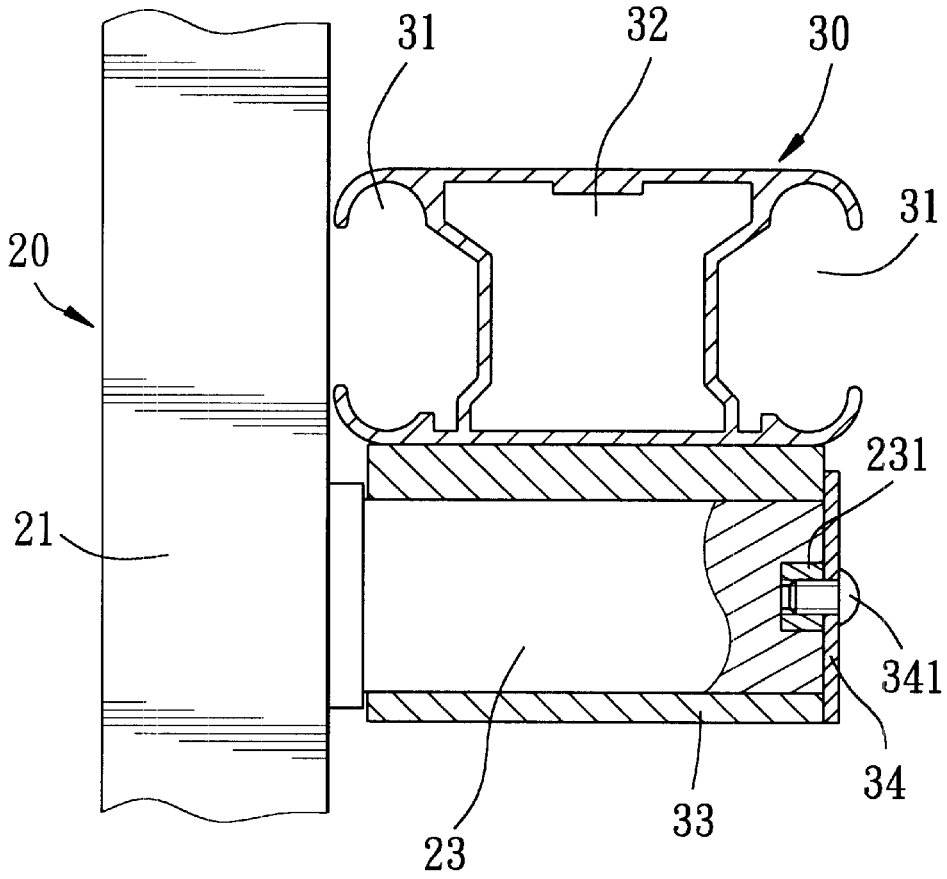
FIG. 5 is a fragmentary sectional view of the preferred embodiment, illustrating how a front post is connected to a lever arm.

Referring to FIGS. 2 and 5, the lever arms 30 are disposed on opposite lateral sides of the base frame 20. Each of the lever arms 30 has a front end portion formed with a coupling sleeve 33 on its bottom side for coupling rotatably with a respective one of the pivot shafts 23 on the front post 21. The respective one of the pivot shafts 23 is retained in the coupling sleeve 33 by means of an end plate 34 and a screw 341 that fastens the end plate 34 to a nut 231 buried securely in one end of the pivot shaft 23. For the sake of reduction in weight, each of the lever arms 30 is formed as an elongated hollow body with a pair of longitudinally extending slide grooves 31 formed in two opposite lateral sides thereof, and an intermediate cavity 32 disposed between the slide grooves 31. Each of the lever arms 30 further has a rear end portion formed with an internally threaded first fastener hole 35 (see FIG. 4).

Figure 6:
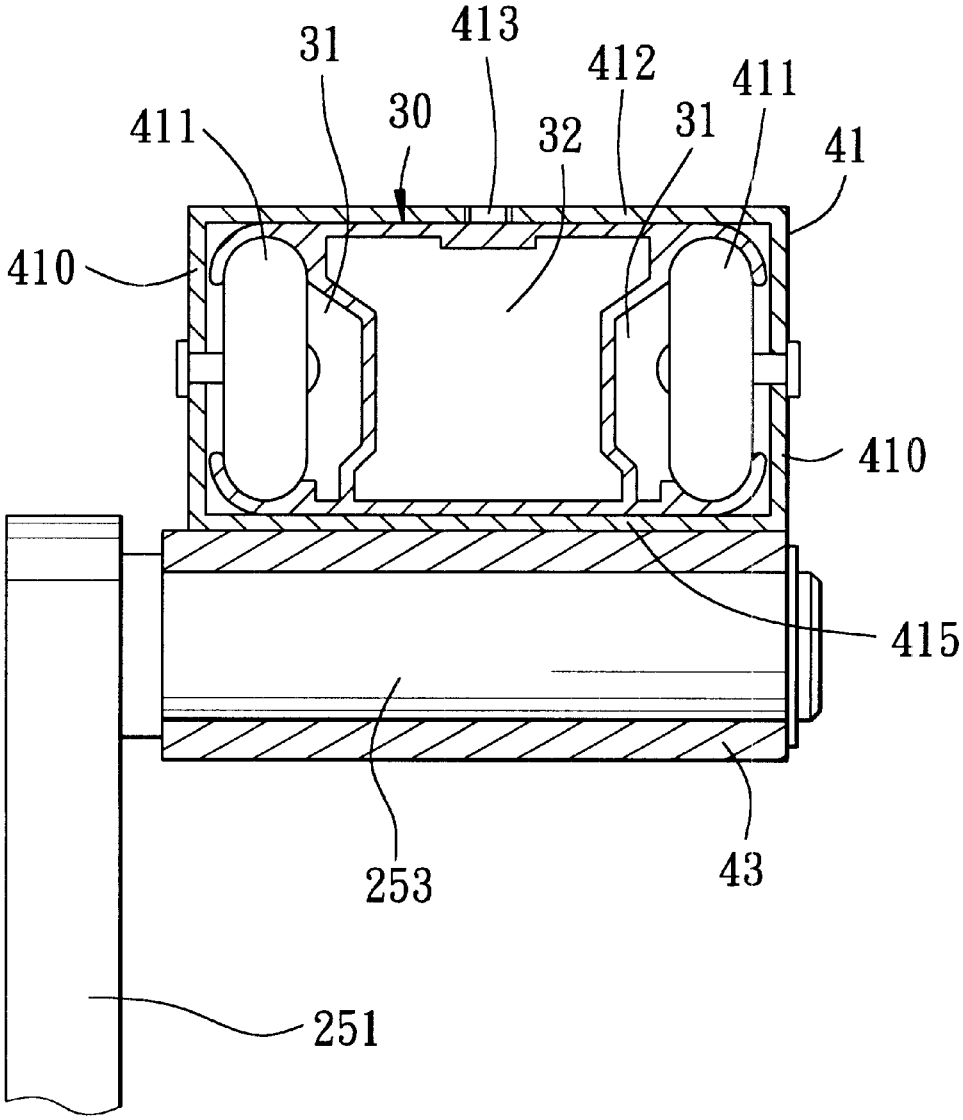
FIG. 6 is another fragmentary sectional view of the preferred embodiment, illustrating how a slide seat is mounted on a lever arm.

Referring to FIGS. 4 and 6, each of the slide seats 41 includes a casing which is disposed around a respective one of the lever arms 30 and which has left and right side walls 410 disposed on opposite lateral sides of the respective one of the lever arms 30, a top wall 412 interconnecting the side walls 410 and disposed over the respective one of the lever arms 30, and a bottom wall 415 interconnecting the side walls 410 and disposed below the respective one of the lever arms 30. The side walls 410 have confronting inner side surfaces, each of which is provided with two rollers 411 which extend into a respective one of the slide grooves 31 in the respective one of the lever arms 30 such that the slide seat 41 is slidable on the respective one of the lever arms 30 along the slide grooves 31. The top wall 412 is formed with an internally threaded second fastener hole 413. The bottom wall 415 has a bottom side provided with a coupling sleeve 43 which extends in a horizontal direction transverse to the longitudinal direction and which is sleeved on a transverse coupling shaft 253 at a distal end of a respective one of the crank arms 251.

Figure 3:
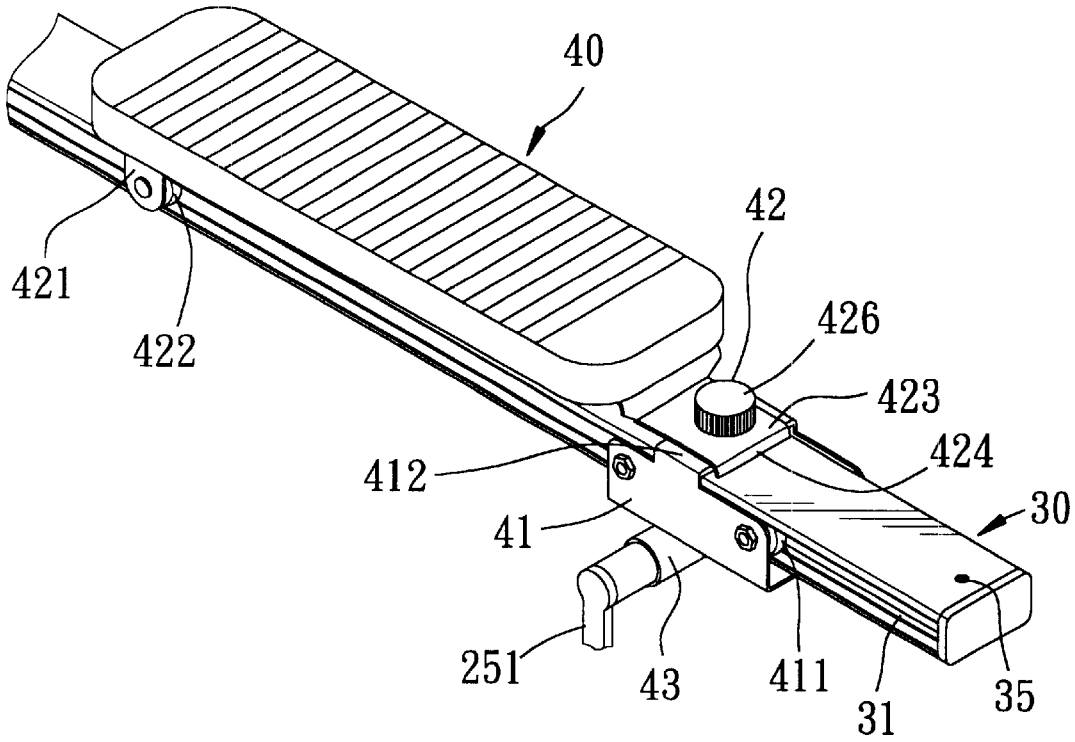
FIG. 3 is a fragmentary perspective view of the preferred embodiment, where a pedal member is shown to be fastened to a slide seat.

Referring to FIGS. 3 and 4, each of the pedal members 40 is disposed over a respective one of the lever arms 30, and has a front end formed with a pair of mounting lobes 421 which extend downwardly to the lateral sides of the respective one of the lever arms 30 and which are provided with rollers 422 that extend respectively into the slide grooves 31 in the respective one of the lever arms 30. Each of the pedal members 40 further has a rear end formed with a horizontal mounting plate 423 which has a mounting hole 425 formed therethrough and a downward flange 424 formed at a rear edge thereof.

Each of the fasteners 42 includes an operating knob 426 disposed over the mounting plate 423 of a respective one of the pedal members 40, and a threaded shank 427 extending through the mounting hole 425 in the mounting plate 423. In one exercise mode, the threaded shanks 427 of the fasteners 42 are fastened to the first fastener holes 35 for fastening the rear ends of the pedal members 40 to the lever arms 30. In another exercise mode, the threaded shanks 427 engage the second fastener holes 413 for fastening the rear ends of the pedal members 40 to the slide seats 41.

Figure 7:
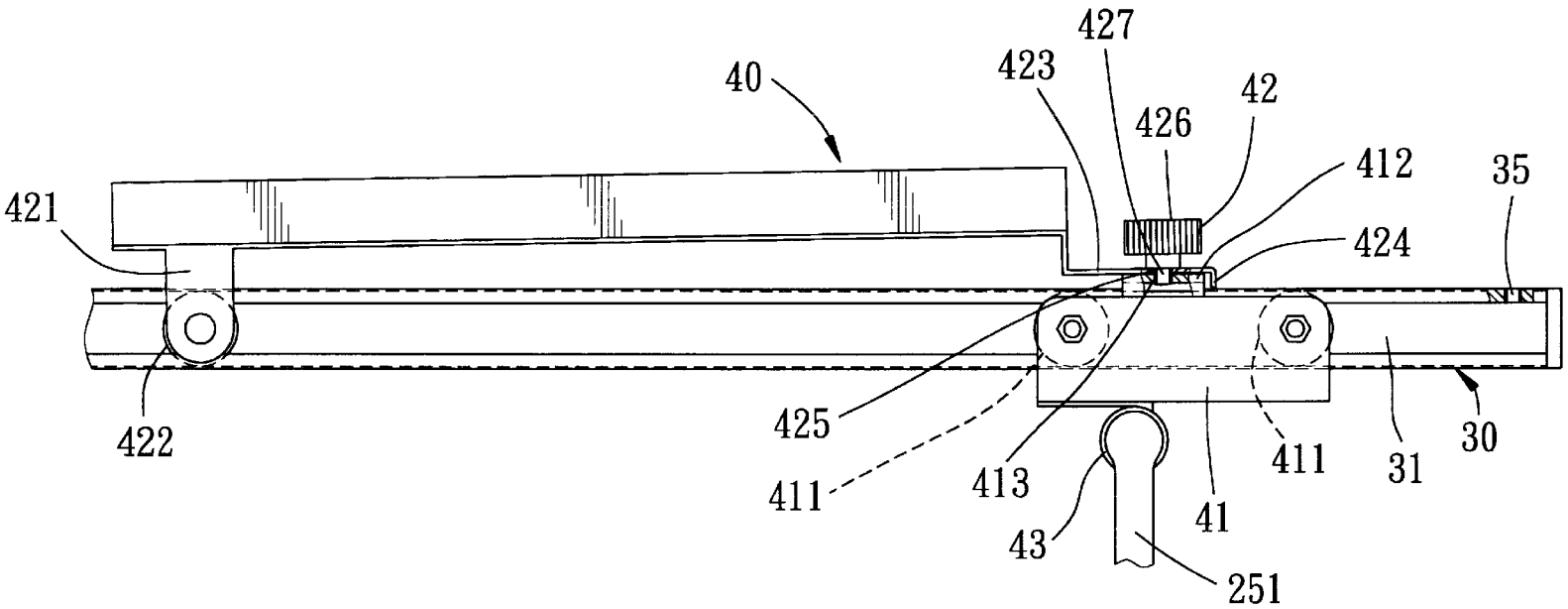
FIG. 7 is a fragmentary side view, illustrating the preferred embodiment when the pedal members are fastened to the slide seats.
Figure 9:
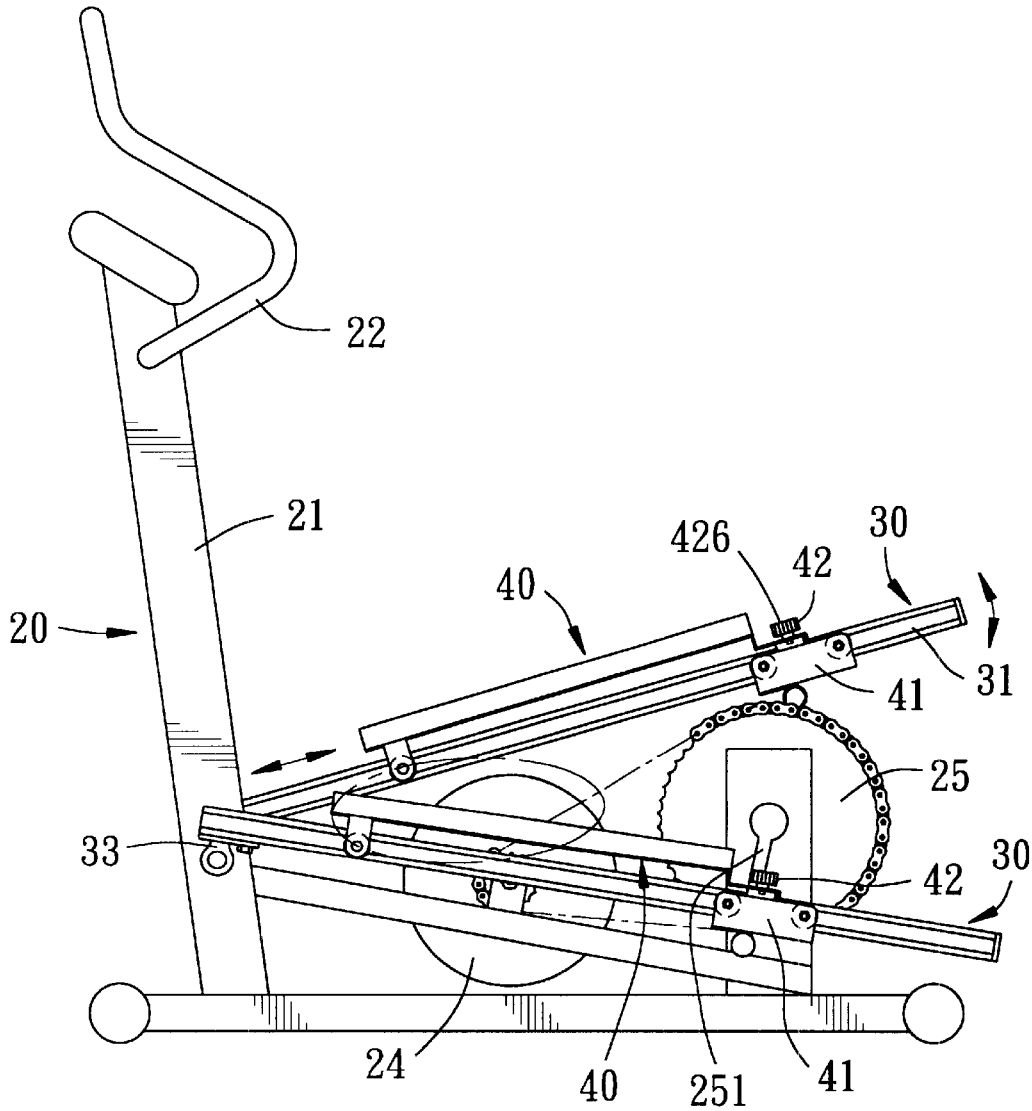
FIG. 9 is a side view illustrating the preferred embodiment when operated to perform a cycling exercise mode.

Referring to FIGS. 7 and 9, when it is desired to perform the cycling exercise mode with the use of the exerciser of the present embodiment, the downward flanges 424 on the mounting plates 423 are hooked to rear edges of the top walls 412 of the slide seats 41, and the threaded shanks 427 of the fasteners 42 are threaded into the second fastener holes 413 in the top walls 412 of the slide seats 41 for fastening the rear ends of the pedal members 40 to the slide seats 41. Since the slide seats 41 engage slidably the slide grooves 31 in the lever arms 30 and are coupled to the crank arms 251 of the drive wheel 25, and since the front ends of the pedal members 40 engage slidably the lever arms 30 by virtue of the rollers 422, the pedal members 40 are slidable on the lever arms 30 along circulating routes of the crank arms 251 when the user steps on the pedal member 40 to cause upward and downward pivoting movements of the lever arms 30.

Figure 8:
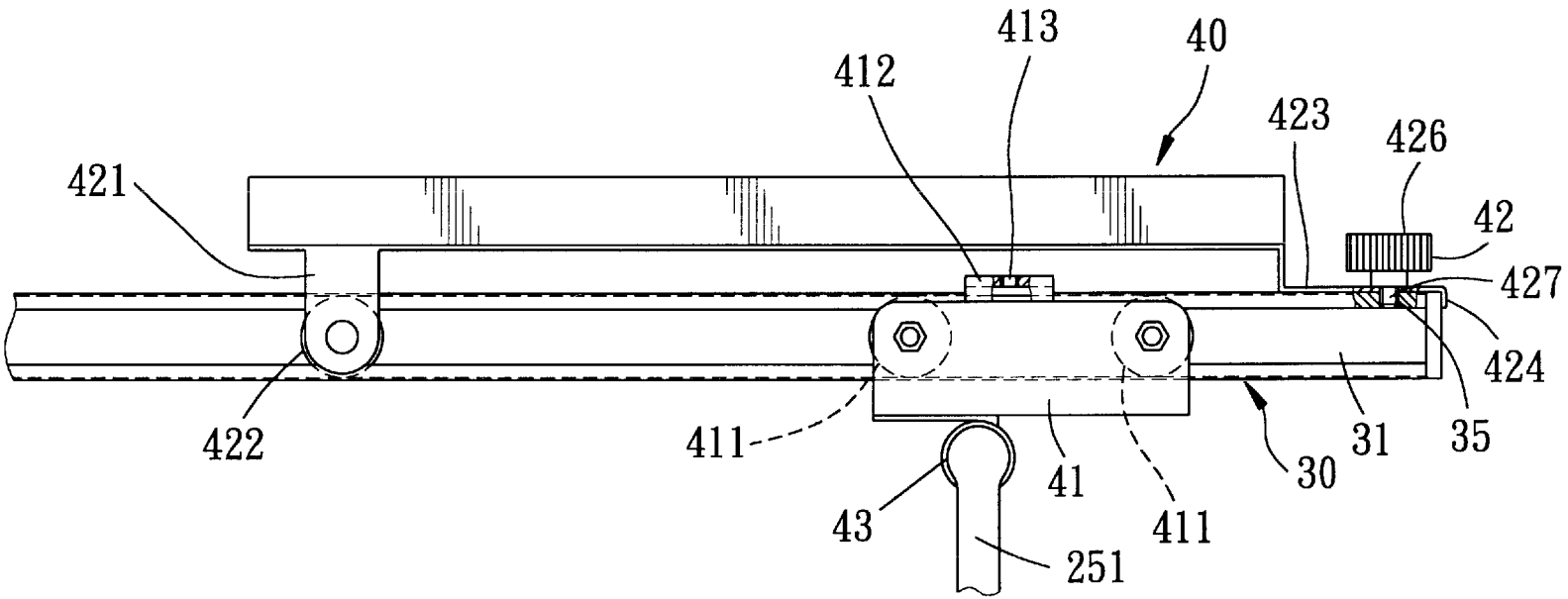
FIG. 8 is a fragmentary side view, illustrating the preferred embodiment when the pedal members are fastened to the lever arms.
Figure 10:
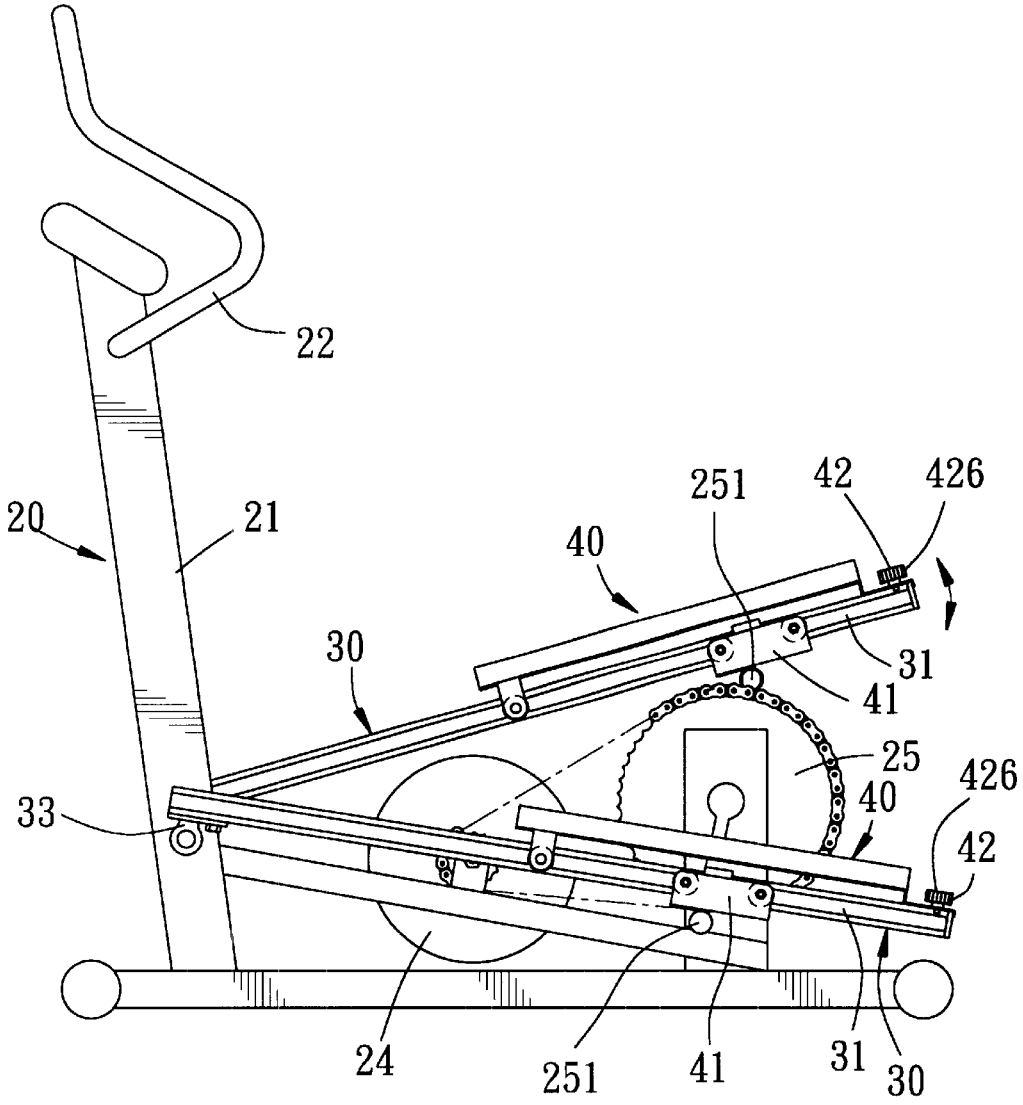
FIG. 10 is a side view illustrating the preferred embodiment when operated to perform a stepping exercise mode.

Referring to FIGS. 8 and 10, when it is desired to perform a stepping exercise mode, the downward flanges 424 on the mounting plates 423 are hooked to rear edges of the rear end portions of the lever arms 30, and the threaded shanks 427 of the fasteners 42 are threaded into the first fastener holes 35 in the rear end portions of the lever arms 30 for fastening the pedal members 40 to the lever arms 30. The slide seats 41 are sleeved slidably on the lever arms 30, and are disposed between the front and rear ends of the pedal members 40. Since the slide seats 41 are coupled to the crank arms 251 and engage slidably the lever arms 30, when the user steps on the pedal members 40, the lever arms 30 pivot upwardly and downwardly together with the pedal members 40 to cause the slide seats 41 to slide along the lever arms 30, thereby driving movement of the crank arms 251 and thereby propelling rotation of the drive wheel 25.

It has thus been shown that the exerciser of the present invention incorporates two different exercise functions in a single apparatus. Conversion from one exercise mode to another can be easily accomplished by operating the fasteners 42 for fastening the pedal members 40 selectively to the lever arms 30 and to the slide seats 41, as desired.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combined cycling and stepping exerciser comprising:

a base frame having a front end portion with an upright post, and a rear end portion opposite to said front end portion in a longitudinal direction, said upright post being formed with a pair of horizontal pivot shafts that project in opposite lateral directions transverse to the longitudinal direction;

a drive wheel mounted rotatably on said rear end portion of said base frame, said drive wheel having a horizontal wheel axle transverse to said longitudinal direction, and a pair of crank arms coupled to said wheel axle and disposed on opposite lateral sides of said drive wheel;

a pair of elongated lever arms disposed on opposite lateral sides of said base frame, each of said lever arms having a front end portion pivoted to a respective one of said pivot shafts on said upright post, a rear end portion, and a longitudinally extending slide groove extending between said front and rear end portions;

a pair of slide seats, each of which is coupled to a respective one of said crank arms and engages slidably said slide groove in a respective one of said lever arms so as to be slidable along said slide groove when said drive wheel rotates;

a pair of pedal members disposed respectively on said lever arms, each of said pedal members having a front end engaging slidably said slide groove in the respective one of said lever arms, and a rear end; and fasteners which are operable for fastening said rear ends of said pedal members selectively and respectively to said slide seats and to said rear end portions of said lever arms.

2. The combined cycling and stepping exerciser as claimed in claim 1, further comprising a resistance wheel mounted rotatably on said base frame and coupled to said drive wheel for providing resistance to rotation of said drive wheel.

3. The combined cycling and stepping exerciser as claimed in claim 1, wherein each of said lever arms is formed with two of said slide grooves in opposite lateral sides thereof.

4. The combined cycling and stepping exerciser as claimed in claim 3, wherein said front end of each of said pedal members has a pair of mounting lobes which extend downwardly to said lateral sides of the respective one of said lever arms, each of said mounting lobes being provided with a roller which extends into a respective one of said slide grooves in the respective one of said lever arms.

5. The combined cycling and stepping exerciser as claimed in claim 3, wherein each of said slide seats is sleeved on the respective one of said lever arms and has a pair of side walls disposed respectively on the opposite lateral sides of the respective one of said lever arms, said side walls having confronting inner side surfaces, each of which is provided with at least one roller that extends into a respective one of said slide grooves in the respective one of said lever arms.

6. The combined cycling and stepping exerciser as claimed in claim 5, wherein said rear end of each of said pedal members has a horizontal mounting plate which is formed with a mounting hole for mounting a respective one of said fasteners therein, each of said fasteners having an operating knob disposed over said mounting plate of a respective one of said pedal members, and a threaded shank extending through said mounting hole in said mounting plate, each of said slide seats further having a top wall interconnecting said side walls and disposed over the respective one of said lever arms, said top wall being formed with an internally threaded fastener hole for engaging threadedly said threaded shank of a respective one of said fasteners when said rear ends of said pedal members are fastened to said slide seat, said rear end portion of each of said lever arms being formed with an internally threaded fastener hole on a top side of said lever arm for engaging threadedly said threaded shank of a respective one of said fasteners when said rear ends of said pedal members are fastened to said rear end portions of said lever arms.

7. The combined cycling and stepping exerciser as claimed in claim 6, wherein said top wall of each of said slide seats has a rear edge, said rear end portion of each of said lever arms having a rear edge, said mounting plate of each of said pedal members being formed with a downward flange for engaging said rear edge of said top wall of the respective one of said slide seats when said mounting plate is fastened to the respective one of said slide seats, and for engaging said rear edge of said rear end portion of the respective one of said lever arms when said mounting plate is fastened to said rear end portion of the respective one of said lever arms.

8. The combined cycling and stepping exerciser as claimed in claim 6, wherein each of said slide seats further has a bottom wall disposed below the respective one of said lever arms and interconnecting said side walls, said bottom wall having a bottom side provided with a coupling sleeve that extends in a horizontal direction transverse to said longitudinal direction and that is coupled to a distal end of a respective one of said crank arms.

* * * * *